US007025199B1

(12) United States Patent
Lim

(10) Patent No.: US 7,025,199 B1
(45) Date of Patent: Apr. 11, 2006

(54) FOLDING SERVING TRAY

(76) Inventor: Edmond Heng Lim, 1745 Walnut St., El Cerrito, CA (US) 94530

( * ) Notice: Subject to any disclaimer, the term of this patent is extended or adjusted under 35 U.S.C. 154(b) by 11 days.

(21) Appl. No.: 10/778,862

(22) Filed: Feb. 13, 2004

(51) Int. Cl.
*B65D 5/48* (2006.01)

(52) U.S. Cl. ..... 206/217; 206/478; 206/565; 206/784; 229/904

(58) Field of Classification Search ..... 229/117.16, 229/198.2, 904, 906, 117.17, 120.15; 206/562, 206/564, 565, 217, 218, 426, 541, 815, 756, 206/477, 478, 481, 784
See application file for complete search history.

(56) References Cited

U.S. PATENT DOCUMENTS 905,449 A * 12/1908 Morton ..... 206/516
1,456,060 A * 5/1923 Johnstone ..... 206/249
2,333,715 A * 11/1943 Hahnemann ..... 206/763
2,634,899 A * 4/1953 Meller ..... 229/195
2,808,191 A * 10/1957 Cramer ..... 206/562
2,809,775 A * 10/1957 White ..... 229/120
3,221,976 A * 12/1965 Steckert ..... 229/117.16
3,226,006 A * 12/1965 Dunn ..... 229/195
3,640,380 A * 2/1972 Huffman ..... 206/549
4,981,217 A * 1/1991 Lim ..... 206/561
5,421,459 A * 6/1995 Mazzotti ..... 206/549
5,429,057 A * 7/1995 Buescher ..... 108/43
5,524,814 A * 6/1996 Davis ..... 229/117.08
5,549,241 A * 8/1996 Correll ..... 229/120.01
5,593,062 A * 1/1997 Martin ..... 220/574.1
6,708,874 B1 * 3/2004 Montgomery ..... 229/117.16

* cited by examiner

*Primary Examiner*—David T. Fidei
*Assistant Examiner*—Jerrold Johnson
(74) *Attorney, Agent, or Firm*—Risto A. Rinne, Jr.

(57) ABSTRACT

An apparatus for containing a food and beverage includes a substantially flat stock, for example, cardboard or fiberboard that includes a plurality of perimeter panels that are folded into a three-dimensional apparatus. When formed, the apparatus includes a compartment for holding a food and a beverage. A beverage retaining member attaches in any of a variety of ways where desired to any of the panels to secure various sizes of beverage containers in an upright position on top of a center panel. The outer perimeter panels are each attached on one edge thereof to the center panel and interlock with each other during assembly to prevent accidental opening of the apparatus. A notch is provided to accept a thumb of a user and a semi-spherical opening is provided to receive a napkin or utensil.

14 Claims, 4 Drawing Sheets

FOLDING SERVING TRAY

This application is related to a prior patent application, filed by the same inventor on Dec. 30, 2003, entitled "Folding Serving Tray", Ser. No. 10/749,058.

BACKGROUND OF THE INVENTION

1. Field of the Invention

The present invention, in general relates to paper plates and, more particularly, a serving tray that is shipped flat and folded open into a three-dimensional tray.

Paper plates are well known. Variations include serving trays that are folded from a flat sheet into a substantially three-dimensional structure. These are often used in the food service industry to contain food that is to be consumed. They are typically discarded after a single use.

For example, these prior devices often form a simple tray with vertical sides and open top when folded open. They are used for a variety of purposes, some of which include holding French Fries, hamburgers, hot dogs, and other typical fast food items but not a drink cup or can. They are used in ball parks and by various food vendors.

While useful, there are needs that all known prior types of devices fail to satisfy. For example, the prior known folding serving trays either cannot or have great difficulty simultaneously holding a beverage. This is because a beverage is heavy and the thin cardboard (i.e., fiberboard) used for such construction fails to support the beverage which can tilt and spill as the support fails. A hot beverage that is spilled on a person can cause injury which is a liability risk.

Also, beverages typically come in a variety of differently sized cylindrical containers, for example, soda cans, individual cups, coffee cups, etc. Some of these include a tapered diameter and therefore are substantially frusta-conical in shape. There has been no reliable, safe, and convenient way to securely house a great many of the different sizes and styles of beverage containers.

Another need is to provide a way to hold the serving tray at a balance point, proximate a center of gravity when it is loaded.

There is also a need to be able to store a napkin or eating utensils, for example a plastic fork or spoon, most typically being used, simultaneously while the food is contained in the tray.

An especially important need is for the container to retain its "folded-open" position. The sides of previous trays tend to be easily displaced, especially so when the weight of contents in the tray bears upon the sides of the tray. This can cause food items placed therein to spill out of the tray. Food spilled on a person can ruin clothes which is another liability risk. There is a need to ensure that a folding serving tray, once folded into the open position adapted for use, stays in that position.

Accordingly, there exists today a need for a folding serving tray that helps ameliorate the above-mentioned difficulties.

Clearly, such an apparatus would be a useful and desirable device.

2. Description of Prior Art

Paper plates and trays are, in general, known. For example, the following patent describes a similar type of device:

U.S. Pat. No. 4,981,217 to Edmond Lim, Jan. 1, 1991.

While the structural arrangement of the above described device, at first appearance, has similarities with the present invention, it differs in material respects. These differences, which will be described in more detail hereinafter, are essential for the effective use of the invention and which admit of the advantages that are not available with the prior device.

OBJECTS AND SUMMARY OF THE INVENTION

It is an object of the present invention to provide a folding serving tray that is formed out of a flat stock.

It is also an important object of the invention to provide a folding serving tray that is formed from a cardboard.

Another object of the invention is to provide a folding serving tray that is formed from a fiberboard.

Still another object of the invention is to provide a folding serving tray that can be shipped flat and folded open for use.

Still yet another object of the invention is to provide a folding serving tray that can be quickly folded open for use.

Yet another important object of the invention is to provide a folding serving tray that includes panels that can be locked into position once the tray has been opened.

Still yet another important object of the invention is to provide a folding serving tray that includes panels that resist dislodging after assembly has occurred.

A first continuing object of the invention is to provide a folding serving tray that includes a compartment for holding a beverage that includes a restraining member.

A second continuing object of the invention is to provide a folding serving tray that includes a compartment for holding a beverage that includes a restraining member that is adapted to secure different diameter beverage containers.

A third continuing object of the invention is to provide a folding serving tray that includes a beverage compartment with a bottom panel of the tray under the beverage.

A fourth continuing object of the invention is to provide a folding serving tray that includes a notch adapted for placement of a thumb therein that is located proximate a center of gravity of the tray when the tray is loaded with a typical assortment of food-related, consumable items.

A fifth continuing object of the invention is to provide a folding serving tray that includes three substantially upright sides with respect to a bottom panel and one remaining side that is disposed at an angle other than normal with respect to the bottom panel.

A sixth continuing object of the invention is to provide a folding serving tray that includes an opening that is adapted to receive a napkin therein.

A seventh continuing object of the invention is to provide a folding serving tray that is adapted to retain a fork, spoon, or knife.

An eighth continuing object of the invention is to provide a folding serving tray that is a one-piece contiguous device, wherein no additional parts or pieces are required for assembly.

A ninth continuing object of the invention is to provide a folding serving tray that is economical to manufacture.

A tenth continuing object of the invention is to provide a folding serving tray that is economical to transport.

An eleventh continuing object of the invention is to provide a folding serving tray that takes up little room when flat and therefore is economical to store.

A twelfth continuing object of the invention is to provide a folding serving tray that can be stamped in one operation.

A thirteenth continuing object of the invention is to provide a folding serving tray that allows placement of a beverage in the same compartment as other food items are placed.

A fourteenth continuing object of the invention is to provide a folding serving tray that includes a retaining member that is adapted to wrap around a portion of a beverage sufficient to retain the beverage in an upright position and which includes a first end that is attached to the tray and a second end that is adapted for placement into an opening provided in the tray.

A fifteenth continuing object of the invention is to provide a folding serving tray that includes a retaining member that is adapted to wrap around a portion of a beverage sufficient to retain the beverage in an upright position and which includes a first end that is attached to the tray and a second end that is adapted for placement into one of a plurality of openings that are provided in the tray.

A sixteenth continuing object of the invention is to provide a folding serving tray that includes a retaining member that is adapted to wrap around a portion of a beverage sufficient to retain the beverage in an upright position and which includes a first end that is attached to the tray and a second end that is adapted for placement into an opening provided in the tray and which can be locked in the opening sufficient to resist removal by an attempted pulling of the second end out of the opening.

Briefly, a folding serving tray that is constructed in accordance with the principles of the present invention is formed from a substantially flat stock, for example, cardboard or fiberboard. When formed, the flat stock includes a variety of sections that include either cuts or perforations to aid in creasing (i.e., bending) portions thereof. The sections fold to produce a three dimensional tray that includes a compartment for holding a food and a beverage. Certain of the sections form panels that interlock together. A retaining member includes a first end that is attached to the tray and a second end that is adapted for placement into an opening provided in the tray. The retaining member extends around a portion of a beverage container. An opening is provided that is adapted to receive a napkin or utensil therein. A notch is adapted to receive a portion of a thumb.

DETAILED DESCRIPTION OF THE INVENTION

Figure 1:
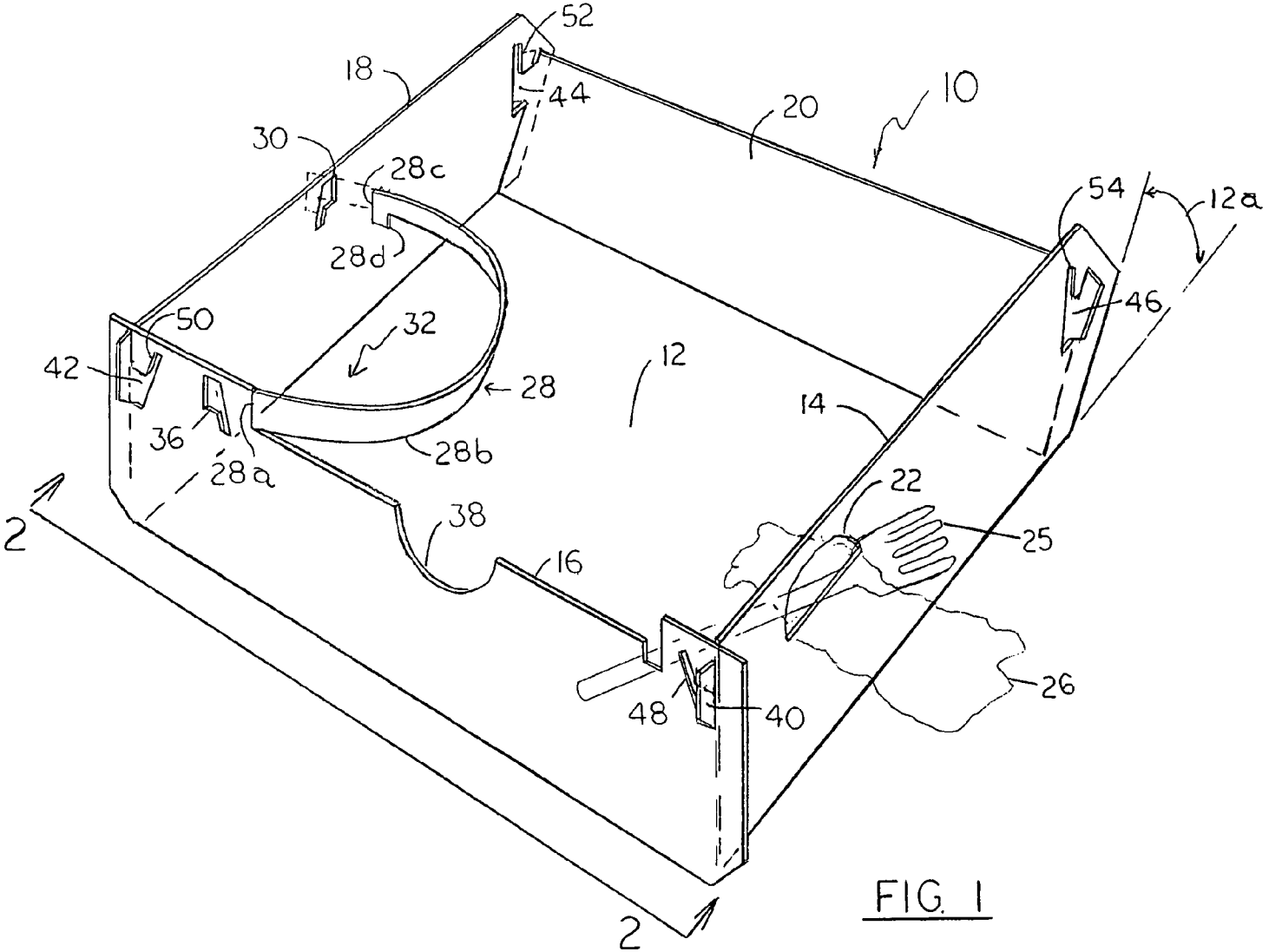
FIG. 1 is a view in perspective of a folding serving tray, assembled and ready for use.
Figure 2:
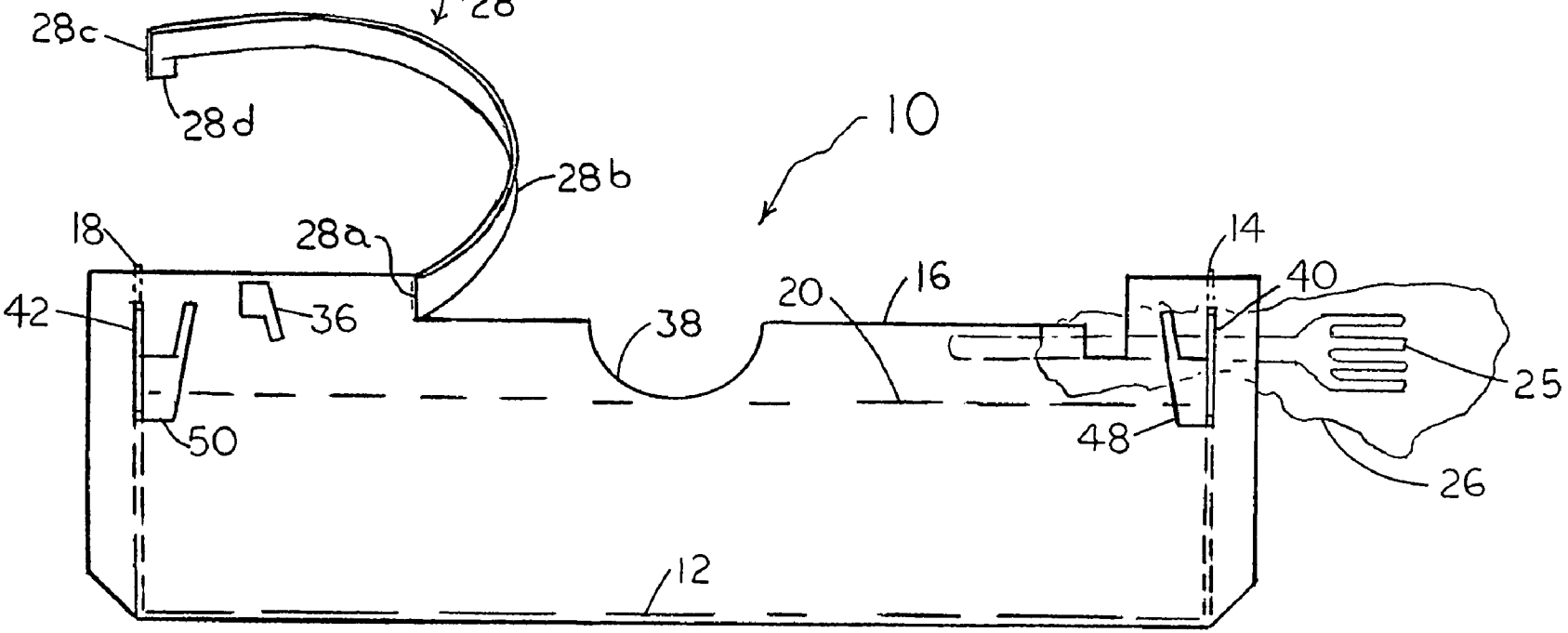
FIG. 2 is a view as shown in FIG. 1 as seen along the lines 2—2 therein.

Referring on occasion to all of the drawings and now, in particular, alternately to both FIG. 1 and FIG. 2 is shown, a folding serving tray, identified in general by the reference numeral 10.

The folding serving tray 10 includes a bottom center panel 12, an upright first panel 14, an upright second panel 16, an upright third panel 18, and an upright fourth panel 20. The first, second, third, and fourth panels 14, 16, 18, 20, are disposed at an angle with respect to the center panel 12 when the folding serving tray 10 is assembled for use.

The preferred angle for the first, second, and third panels 14, 16, 18 is ninety degrees and for the fourth panel 20 is less than ninety degrees, measuring up to it from an extended plane 12*a* of the center panel 12 (see FIG. 1). Of course, if desired, any of the angles could be modified. Those as shown provide a preferred aesthetic appearance and are well suited to carry a beverage and other food stuffs, as described in greater detail hereinafter.

The center panel 12 is attached to each of the first, second, third, and fourth panels 14, 16, 18, 20.

The first panel 14 includes a push-in cutout 22 that includes a semi-circular portion on an upper end of the first panel 14 (when the tray 10 is assembled) and a crease line 24 across the bottom. The crease line 24 forms a secant. To use the cutout 22, the top is pushed in causing the bottom to bend around the crease line 24. A semi-circular opening is thereby provided through the side of the first panel 14. An eating utensil 25 can be inserted through the semi-circular opening or a napkin 26 or both.

The second panel 16 includes a beverage retaining member, identified in general by the reference numeral 28. The beverage retaining member 28 is attached to the second panel 16 at a first end 28*a* thereof and includes a main section 28*b* that extends for a predetermined length. An opposite second end 28*c* thereof includes an extension 28*d*. The opposite second end 28*c*, including the extension 28*d*, is larger than the main section 28*b*.

The third panel 18 includes a first beverage retaining member locking opening 30. The first beverage retaining member locking opening 30 includes a longer angled portion 30*a* (see FIG. 3) that is disposed generally closer toward the fourth panel 20 at the bottom of thereof and generally closer toward the second panel 16 at the top thereof, when the tray 10 is assembled.

The first beverage retaining member locking opening 30 includes a retaining portion 30*b* (see FIG. 3) that is attached to a top of the longer angled portion 30*a*. The retaining portion 30*b* provides an opening that is shorter than the longer angled portion 30*a*. It is also shorter than the combined length of the opposite second end 28*c* and the extension 28*d* of the beverage retaining member 28.

In use the opposite second end 28*c*, including the extension 28*d* of the beverage retaining member 28, is inserted through the first beverage retaining member locking opening 30 at an angle that corresponds with that of the longer angled portion 30*a* of the first beverage retaining member locking opening 30.

The opposite second end 28*c* of the beverage retaining member 28 is then urged toward the retaining portion 30*b*, as shown in dashed lines in FIG. 1.

Accordingly, the beverage retaining member 28 is now locked in position in the first beverage retaining member locking opening 30.

Any pressure exerted on the beverage retaining member 28 attempting to pull it our of the first beverage retaining member locking opening 30 is prevented by the extension 28*d* of the opposite second end 28*c* contacting the retaining portion 30*b*.

The beverage retaining member 28 is held in this position because it must be twisted to align with the longer angled portion 30*a*. After insertion, it naturally straightens into a more vertical position and therefore cannot again pass out of the longer angled portion 30*a*.

Any tension attempting to urge it out only tends to force it even more into a vertical position thereby preventing the beverage retaining member 28 from being accidentally withdrawn out of the first beverage retaining member locking opening 30.

Figure 3:
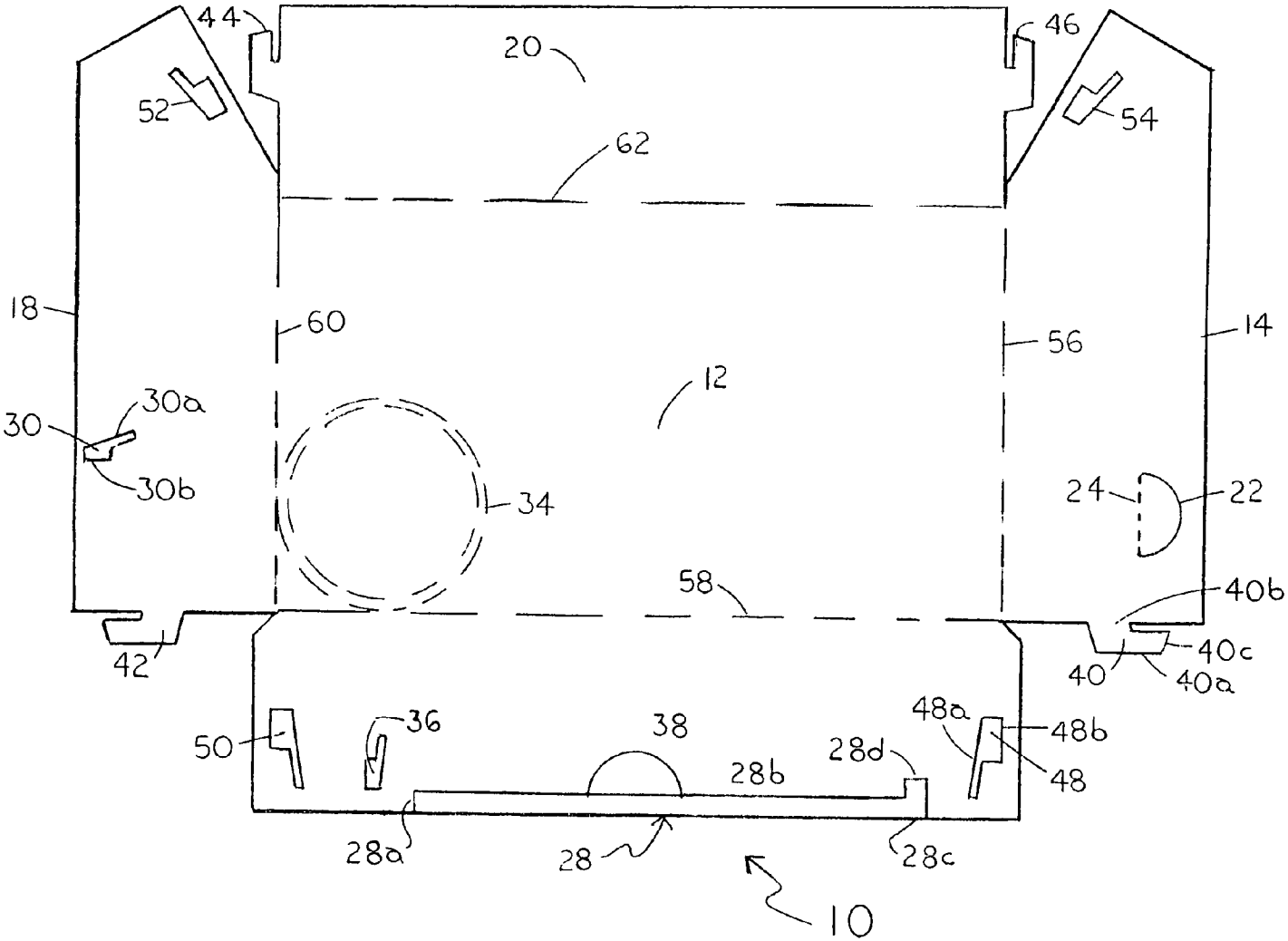
FIG. 3 is the folding serving tray of FIG. 1 in a flat state, after manufacturing, prior to assembly for use.

A space, identified in general by the reference numeral 32, is provided for placing a beverage container 34 (dashed lines, FIG. 3). The beverage retaining member 28 secures the beverage container 34 in an upright position with its bottom disposed on the center panel 12. The beverage retaining member 28 prevents the beverage container 34 from tilting and falling.

A second beverage retaining member locking opening 36 is provided in the second panel 16 to accommodate a smaller diameter of the beverage container 34. As many additional beverage retaining member locking openings as desired can be provided where desired.

The second beverage retaining member locking opening 36 is constructed identical to the first beverage retaining member locking opening 30 except that a bottom of the longer portion is closer toward the first panel 14 than the third panel 18.

This is to ensure that if the smaller diameter beverage container 34 exerts a force on the beverage retaining member 28 attempting to pull it out of the second beverage retaining member locking opening 36, the force exerted will tend to urge the opposite second end 28*c* toward the retaining portion of the second beverage retaining member locking opening 36.

Accordingly, a fail-safe mechanism is provided by the first and second beverage retaining member locking openings 30, 36 that ensure retention of the beverage retaining member 28, once it has been inserted therein.

A semi-circular notch 38 is provided in the top of the second panel 16 under the beverage retaining member 28. When the beverage retaining member 28 is urged away from the second panel 16 (i.e., for attachment to the first or second beverage retaining member locking openings 30, 36) the top of the notch 38 becomes accessible for use.

In use, a left hand of a user grasps the second panel 16 placing a portion of the thumb across the notch 38 and a portion of the remaining fingers under the center panel 12. A normal grip tends to align at least a portion of the remaining fingers under the space 32 which automatically provides support for the center panel 12 under the beverage container 34.

Because the beverage container 34 is usually quite heavy, optimum support for the tray 10 is provided under a typical center-of-gravity location. This makes balancing, control, and holding of the tray 10 easy to accomplish.

Of course, the notch 38 can be moved along the second panel 16 (or any other panel) to optimize this position depending upon the size of the tray 10 and the contents it is expected to carry. Similarly, the beverage retaining member 28 can also be moved to any other panel, as desired, or if desired, a multiple may be included, for example, if the tray 10 is used primarily to carry a plurality of the beverage containers 34.

It is noted that the folding serving tray 10 may be formed of any desired material that is substantially planar. Cardboard and fiberboard are preferred materials because they are strong, lightweight, and inexpensive. A material having the stiffness of a good quality paper plate or better is preferred.

If desired, plastics and other materials could be used. For certain applications, the folding serving tray 10 may be cleaned and reused. A higher quality material, for example a durable plastic, may then be used. One such possible application is for home party use. Another is for use aboard a boat. Several of the folding serving trays 10 are used for picnics, birthday parties, and the like. Afterwards, they are washed and disassembled so that they are again flat. Then they are stored flat, ready for the next party or picnic.

Referring now also with regularity to FIG. 3, the first panel 14 includes a first locking tab 40. The third panel 18 includes a second locking tab 42. The fourth panel 20 includes a third locking tab 44 and a fourth locking tab 46.

The second panel 16 includes a first locking opening 48 near the first locking tab 40 and a second locking opening 50 near the second locking tab 42. The third panel 18 includes a third locking opening 52 near the third locking tab 44. The first panel 14 includes a fourth locking opening 54 near the fourth locking tab 46.

Each of the locking tabs 40, 42, 44, 46 cooperates with one of the locking openings 48, 50, 52, 54, respectively. The first locking tab 40 cooperates only with the first locking opening 48. The second locking tab 42 cooperates only with the second locking opening 50. The third locking tab 44 cooperates only with the third locking opening 52. The fourth locking tab 46 cooperates only with the fourth locking opening 54.

The following detailed description for assembly of one of the locking tabs 40 as it cooperates with one of the locking openings 48 applies to each of the locking tabs 40–46 and to each of the corresponding locking openings 48–54.

Each of the locking openings 48–54 includes an important shape that is a scaled version (i.e. typically larger) of the first and second beverage retaining member locking openings 30, 36. Each locking opening 48–54 includes a first elongated portion 48*a* and a second shorter portion 48*b* that are joined together in the middle. The elongated portion 48*a* is long enough to accept entry of an outer portion 40*a* of the corresponding locking tab (40). The outer portion 40*a* is attached to one end of an intermediate member 40*b* that is shorter than the outer portion 40*a*. The remaining end of the intermediate member 40*b* is attached to an edge of one of the panels (14).

The locking tab 40 is pushed in through the first elongated portion 48*a* of the corresponding locking opening 48 until the outer portion 40*a* of the locking tab 40 is disposed beyond (i.e., past) the outside surface of the second panel 16. Then the locking tab 40 is urged in a direction that is away from the first elongated portion 48*a* and toward the second shorter portion 48*b* of the locking opening 48. A nose portion 40*c* of the outer portion 40*a* of the locking tab 40 is then disposed on an exterior (i.e., past) the second panel 16 and proximate the second shorter portion 48*b* of the locking opening 48. This prevents an outward force from dislodging the locking tab 40 out of the locking opening 48.

To release the locking tab 40 from a position of cooperation with the corresponding locking opening 48, the locking tab 40 must first be urged toward the first elongated portion 48*a* and then it can be separated (i.e., pulled away) from the second panel 16 that includes the locking opening 48. This procedure, for locking and unlocking, applies to any of the locking tabs 40–46 and the openings 48–54. Accordingly, means are provided to ensure that the folding serving tray 10, once assembled, cannot unintentionally be opened.

It is important to note that each elongated portion 48*a* is generally disposed toward the inside of the panel to which it is included. This is not by accident. Once assembled, items such as any foodstuff, beverage containers 34, French fries (not shown) hot dogs (not shown), hamburgers (not shown) or any other desired object(s) is placed in the tray 10. These objects can exert a force tending to urge each panel 14–20 generally outward, away from the center panel 12. If this were to occur, that particular side of the tray 10 would then open, and its contents (i.e., the objects) could spill. This is undesirable.

Accordingly, the design of the locking tabs 40–46 and the locking openings 48–54 is such that any such outward force exerted by any or all of the panels 14–20 only tends to urge each of the locking tabs 40–46 even more securely into (i.e., toward) the second shorter portion (as in 48*b* of the first locking opening 48) of each of the locking openings 48–54. Therefore, any attempted outward displacement of any of the panels 14–20 only further secures the panels 14–20 to each other. This virtually ensures accidental opening of the tray 10 during use, thereby preventing spills from occurring and eliminating virtually all such liability.

It is important to note that in FIG. 3, a way to differentiate between cuts in the folding serving tray 10 and fold lines (or creases) needs to be provided. Cuts are shown in solid lines. Fold lines are shown in dashed lines.

The folding serving tray 10 includes a first fold line 56, a second fold line 58, a third fold line 60, and a fourth fold line 62.

The fold lines 56–62 may include a crease that is added during manufacture to assist folding and help influence the direction that folding occurs. The fold lines 56–62 may alternately include a series of perforations for that same purpose or a score line, or any combination of the above or any other known method to assist in causing the folding serving tray 10 to fold where desired and how desired.

Any enhancement method for folding the members of the folding serving tray 10 is best chosen to optimally work with the material that the folding serving tray 10 is formed of. For certain materials, merely including a visible fold line may be enough. For commercial applications where the folding is repetitive and becomes second nature, even the visible fold lines may be omitted.

To assemble the folding serving tray 10 for use, there is latitude as to which panel or panels are first assembled. What follows is one suggested procedure.

The folding serving tray 10, after manufacture, is flat as shown in FIG. 3. To begin assembly, the first panel 14 is raised upward along the first fold line 56 until it is nearly perpendicular with respect to the center panel 12. The second panel 16 is similarly raised along the second fold line 58 until it is also perpendicular with respect to the center panel 12.

The first locking tab 40 is then inserted into the first elongated portion 48*a* of the first locking opening 48 and is generally urged toward the first panel 14 so as to displace the intermediate portion 40*b* of the locking tab 40 inside the second shorter portion 48*b*. This position ensures that the nose portion 40*c* will be disposed beyond the second panel 16 and proximate the second shorter portion 48*b* of the first locking opening 48.

The second locking tab 42 is then locked in a position of cooperation with respect to the second locking opening 50 of the second panel 16.

The third panel 18 is similarly raised along the third fold line 60 until it is nearly perpendicular with respect to the center panel 12. The second locking tab 42 is then inserted into the elongated portion of the second locking opening 50 and is generally urged in a direction that is away from the first panel 14 to lock it in place, in a similar manner to that as previously described.

At this time, the second panel 16, being supported at both ends, is especially secure.

The fourth panel 20 is then raised along the fourth fold line 62 to an angle (preferably less than 90 degrees) that allows the third locking tab 44 to enter into the elongated portion of the third locking opening 52 and the fourth locking tab 46 to enter into the elongated portion of the fourth locking opening 54. The fourth panel 20 is then urged in a direction that is generally away from the second panel 16 sufficient to lock the third locking tab 44 and the fourth locking tab 46 in place.

As can be seen, any foodstuff placed on the center panel 12 is surrounded by the four raised panels 14–20. Any force exerted on the fourth panel 20 (by the weight of the foodstuff) tending to urge it away from the center panel 12 only further tends to secure the fourth panel 20 in the locked position, thereby ensuring that the fourth panel 20 cannot separate during use.

Similarly, a force tending to urge the second panel 16 (or any other panel 14, 18, 20) away from the center panel 12 is prevented from doing so at an end of the second panel 16 where the first (or corresponding) locking tab 40 is located because such a force only tends to further secure the first (or corresponding) locking tab 40 in place.

In the preferred version of the folding serving tray 10, the angle that the fourth panel 20 is raised is less than ninety degrees but, if desired, it could be at ninety degrees thereby resulting in all four panels 14–20 being perpendicular with respect to the center panel 12. This is a matter of preference.

The folding serving tray 10 can be used to hold various foodstuffs as it is presently assembled.

If the folding serving tray 10 is to be disassembled, the process is reversed until disassembly is complete.

It is also noted that the folding serving tray 10 can be easily manufactured by stamping out its pattern onto the stock (i.e., material) that is used for its construction. All of the cuts occur automatically as do any desired perforations, score lines, or creases. It is further noted that very little of the stock is wasted as most of the area contains material that is used.

Figure 4:
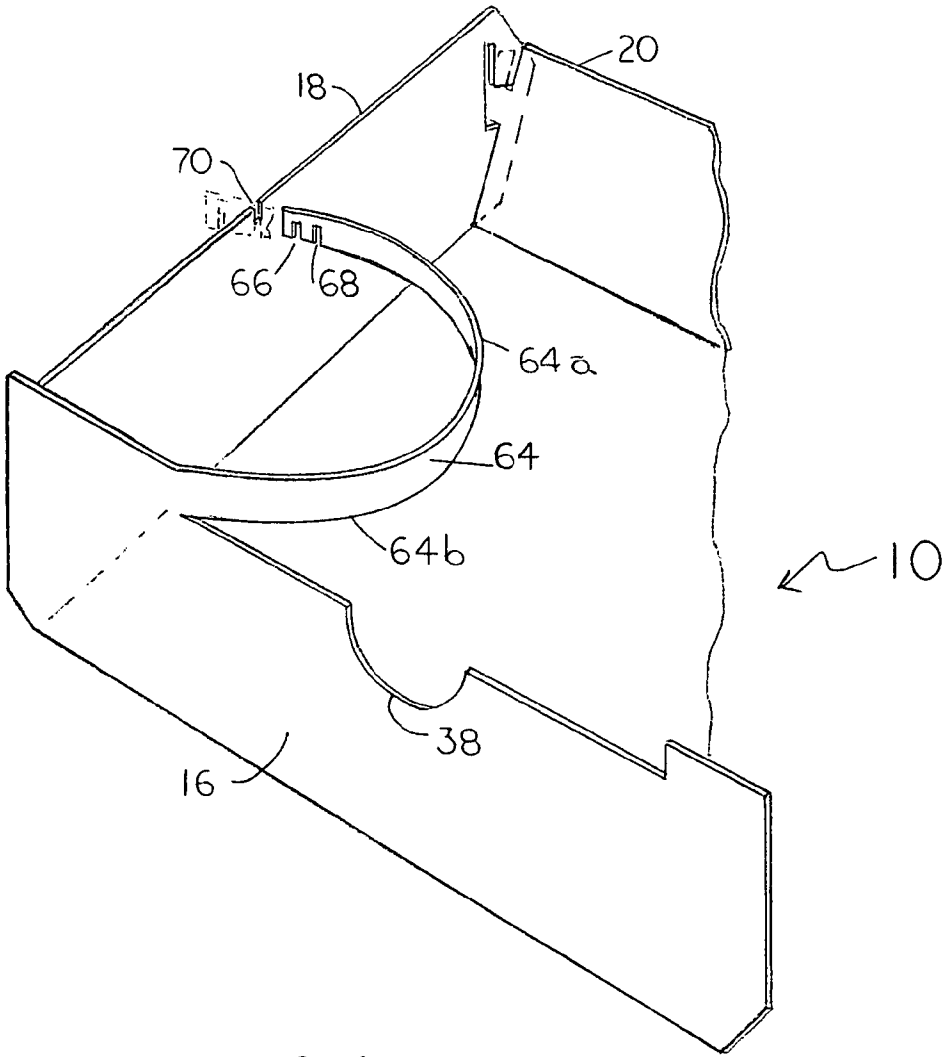
FIG. 4 is a partial view in perspective of the folding serving tray of FIG. 1, with a modified beverage retaining member.

Referring now to FIG. 4, is shown a partial view in perspective of the folding serving tray 10 with a modified beverage retaining member 64.

The modified beverage retaining member 64 includes a flat upper edge 64*a*. An opposite bottom edge 64*b* includes at least two substantially rectangular recesses 66, 68 that are spaced apart from each other and which have been removed from the modified beverage retaining member 64. Additional spaced apart recesses (not shown) can also be included in the bottom edge 64*b*.

The third panel 18 includes a modified beverage retaining member locking opening 70. The modified beverage retaining member locking opening 70 includes a substantially rectangular recess that is open on the top edge of the third panel 18 and which extends down into the third panel 18 a predetermined distance. The modified beverage retaining member locking opening 70 is adapted to receive any of the substantially rectangular recesses 66, 68 that are provided in the bottom edge 64*b* of the modified beverage retaining member 64.

When a first substantially rectangular recess 66 is inserted into the modified beverage retaining member locking opening 70, the upper edge 64*a* of the modified beverage retaining member 64 is generally even with the top edge of the third panel 18. The modified beverage retaining member 64 is locked in position (as shown in dashed lines) and resists pulling in an outward direction, thereby securing the beverage container 34 in an upright position.

The first substantially rectangular recess 66 provides maximum length for the modified beverage retaining member 64 to extend around the beverage container 34 and is therefore suited for use with larger versions of the beverage container 34.

If the beverage container 34 includes a smaller diameter, then the second substantially rectangular recess 68 is instead placed over and inserted into the modified beverage retaining member locking opening 70, thereby providing a shorter remaining overall length for the modified beverage retaining member 64 to extend around the beverage container 34.

Clearly, additional recesses can located where desired in the modified beverage retaining member 64 to shorten the modified beverage retaining member 64 as desired for any size of the beverage container 34.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A folding serving tray made from a flat stock of material, comprising:

(a) a center panel;

(b) four sidewalls that are attached to and extend upward with respect to said center panel, each of said sidewalls adapted to be attached at each end to another of said sidewalls, said four sidewalls, when attached together, forming a three-dimensional structure that is open on the top and closed on the bottom and which is adapted to receive an item therein;

(c) a beverage retaining member that includes a first end that is attached to one of said sidewalls and an opposite second end and wherein said second end of said beverage retaining member is adapted to cooperate with a beverage retaining opening provided in at least one of said sidewalls; and (d) locking means for securing at least one portion of at least one of said four sidewalls to another of said four sidewalls, and wherein subsequent to an item applying a force inside of said compartment that tends to urge any of said sidewalls away from said center panel, said locking means is urged in a direction that prevents release of said locking means, and including a plurality of beverage retaining openings that are provided in at least one of said sidewalls and wherein at least one of said plurality of beverage retaining openings is provided in a first of said sidewalls and at least one other of said plurality of beverage retaining openings is provided in a second of said sidewalls.

2. The folding serving tray of claim 1 wherein a bottom of a beverage container is adapted to be placed on said center panel and wherein said beverage retaining member is adapted to secure said beverage container in an upright position with respect to said center panel when said center panel is disposed in a horizontal position with respect to a surface of the earth.

3. The folding serving tray of claim 1 including a notch adapted for receiving a portion of a thumb therein, said notch provided in one of said four sidewalls.

4. The folding serving tray of claim 3 wherein said notch includes an open top and a generally semi-spherical shape.

5. The folding serving tray of claim 3 wherein said notch is disposed proximate a center of gravity of said tray when said tray is assembled and adapted to contain a typical assortment of items.

6. The folding serving tray of claim 1 including a push-in cutout in one of said sidewalls, at least a portion of said push-in cutout adapted to be urged in toward said center panel sufficient to provide an opening in said one of said sidewalls adapted for receiving an object therein.

7. The folding serving tray of claim 6 wherein said object includes a napkin.

8. The folding serving tray of claim 6 wherein said object includes a utensil.

9. The folding serving tray of claim 6 wherein said push-in-cutout includes a portion that is attached to said one of said sidewalls and a remaining portion that is adapted to be urged with respect to said one of said sidewalls.

10. The folding serving tray of claim 9 wherein said push-in-cutout includes a generally semi-circular portion and a secant extending across opposite ends of said semi-circular portion, said secant adapted to provide a crease line for folding.

11. The folding serving tray of claim 1 wherein said locking means includes a tab that is attached to said at least one of said four sidewalls and a locking opening that is attached to another of said four sidewalls wherein said tab is adapted to be inserted into said locking opening and wherein said locking opening is adapted to retain said tab in a position of cooperation with respect to said locking opening, and wherein said tab includes an outer portion that is disposed maximally away from said at least one sidewall, said outer portion being attached to one end of an intermediate member, said intermediate member including an opposite end that is attached to said at least one sidewall, and wherein said outer portion includes a length that is greater than said intermediate member and wherein said tab is adapted to enter into said locking opening that is attached to another of said four sidewalls and wherein said locking opening further includes a first elongated portion and an adjoining second shorter portion and wherein said first elongated portion includes a length that is greater than said second shorter portion, and wherein said length of said elongated portion is sufficient to allow said outer portion of said locking tab to pass through said locking opening at said first elongated portion so that all of said outer portion extends beyond said another of said four sidewalls and wherein said shorter portion includes a length that is less than necessary in order to allow said outer portion of said locking tab to pass through said shorter portion, and wherein said locking tab is adapted to be urged toward said shorter portion an amount that is sufficient to dispose a nose portion of said outer portion beyond said shorter portion sufficient to prevent said outer portion of said locking tab from passing through said shorter portion of said locking opening.

12. The folding serving tray of claim 11 wherein said tab includes an outer portion that is disposed maximally away from said at least one sidewall, said outer portion being attached to one end of an intermediate member, said intermediate member including an opposite end that is attached to said at least one sidewall, and wherein said outer portion includes a length that is greater than said intermediate member and wherein said tab is adapted to enter into said locking opening that is attached to another of said four sidewalls and wherein said locking opening further includes a first elongated portion and an adjoining second shorter portion and wherein said first elongated portion includes a length that is greater than said second shorter portion, and wherein said length of said elongated portion is sufficient to allow said outer portion of said locking tab to pass through said locking opening at said first elongated portion so that all of said outer portion extends beyond said another of said four sidewalls and wherein said shorter portion includes a length that is less than necessary in order to allow said outer portion of said locking tab to pass through said shorter portion, and wherein said locking tab is adapted to be urged toward said shorter portion an amount that is sufficient to dispose a nose portion of said outer portion beyond said shorter portion sufficient to prevent said outer portion of said locking tab from passing through said shorter portion of said locking opening.

13. The folding serving tray of claim 1 wherein said second end of beverage retaining member includes at least two recesses formed in a bottom edge thereof and wherein at least one of said sidewalls includes a substantially rectangular beverage retainer locking member that is open at the top of said at least one of said sidewalls and extends therein a predetermined distance and wherein any of said at least two recesses are adapted to cooperate with said beverage retainer locking member sufficient to retain a beverage in an upright position with respect to said center panel.

14. An improvement to a folding serving tray wherein when said folding serving tray is assembled for use, the improvement comprises:

a center panel and a plurality of generally upright panels disposed around a portion of said center panel that form a three-dimensional compartment over said center panel that is adapted to receive an item therein; and a beverage retaining member that includes a first end that is attached to said tray and an opposite second end and wherein said second end of said beverage retaining member is adapted to cooperate with one of a plurality of beverage retaining openings, a first of said plurality of beverage retaining openings provided in one of said upright panels and a second of said plurality of beverage retaining opening provided in another of said upright panels.

* * * * *